United States Patent [19]

Danguillier et al.

[11] 4,406,746

[45] Sep. 27, 1983

[54] COKE DRY COOLER IN THE FORM OF A SHAFT

[75] Inventors: Wilhelm Danguillier; Jürgen Tietze, both of Bochum; Wolfgang Grams, Herne; Heinz Thubeauville, Bochum, all of Fed. Rep. of Germany

[73] Assignee: Dr. C. Otto & Comp. G.m.b.H., Bochum, Fed. Rep. of Germany

[21] Appl. No.: 346,381

[22] Filed: Feb. 5, 1982

[30] Foreign Application Priority Data

Feb. 11, 1981 [DE] Fed. Rep. of Germany ..... 3104795

[51] Int. Cl.[3] ..... C10B 39/02; C10B 39/10

[52] U.S. Cl. ..... 202/228; 201/39

[58] Field of Search ..... 202/228; 201/39

[56] References Cited

U.S. PATENT DOCUMENTS

| | | | |
|---|---|---|---|
| 1,481,873 | 1/1924 | Moetteli | 202/228 |
| 4,211,607 | 7/1980 | Privalov et al. | 201/39 |
| 4,342,626 | 8/1982 | Jakobi et al. | 202/228 |

FOREIGN PATENT DOCUMENTS

| | | | |
|---|---|---|---|
| 3009818 | 10/1981 | Fed. Rep. of Germany . | |
| 571384 | 5/1924 | France | 202/228 |
| 2076131 | 11/1981 | United Kingdom | 202/228 |

*Primary Examiner*—Bradley Garris

*Attorney, Agent, or Firm*—Thomas H. Murray; Clifford A. Poff

[57] ABSTRACT

In a coke dry shaft cooler having a smaller receiving chamber, and therebelow, a larger cooling chamber, a wear-resistant inward projection is provided at the transition between the two chambers to overcome difficulties caused by uneven particle distribution within the cooler.

7 Claims, 1 Drawing Figure

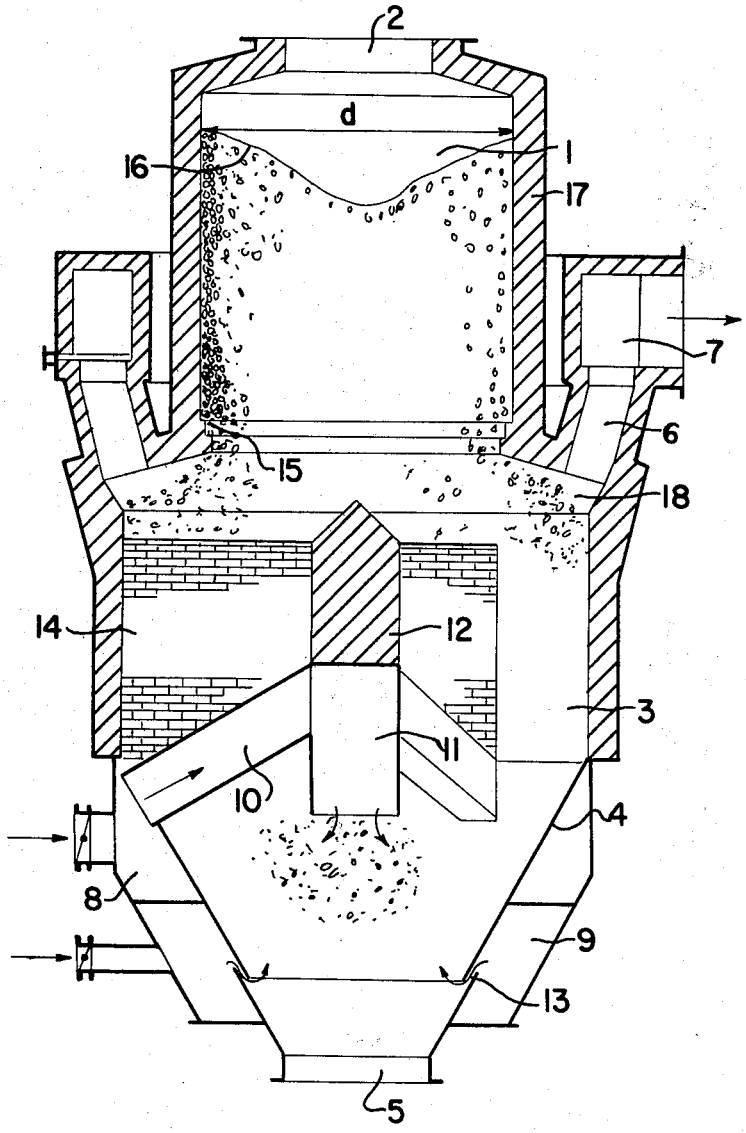
2
d
1
16
17
7
6
15
18
14
12
3
11
10
4
8
9
13
5

COKE DRY COOLER IN THE FORM OF A SHAFT

BACKGROUND OF THE INVENTION

1. Field of the Invention

This invention relates to a coke dry cooler in the form of a shaft.

2. Description of the Prior Art

In prior-art shaft ovens of this kind, the coarser pieces of the coke to be cooled move to the periphery of the shaft during charging, while the smaller pieces of coke accumulate at the center. Since the resistance to the flow of cooling gases is much lower in the pile of coarse pieces than in the pile of smaller particles, the tendency of the flow of gas which is intended to cool the coke charge in the container to keep to the edges is further increased. Great difficulties have arisen in connection with the cooling of dry coke because of the uneven particle distribution within the shaft cooler.

SUMMARY OF THE INVENTION

The object of this invention is to obviate, inside the shaft cooler, any separation of the coke charge which results in the shifting to the periphery of the container of the coarser pieces of coke.

It has surprisingly been found that this can be done very efficiently with simple structural means if, according to the invention, the shaft is provided, in the region of the transition between the top-receiving chamber and the cooling chamber, with a continuous inward projection which is highly resistant to wear.

BRIEF DESCRIPTION OF THE DRAWING

A complete understanding of the invention may be obtained from the foregoing and following description thereof, taken in conjunction with the accompanying single FIGURE drawing which is a vertical central sectional view, partly diagrammatic, of a coke oven dry cooler in the form of a shaft in accordance with the invention.

DESCRIPTION OF THE PREFERRED EMBODIMENT

This invention relates to a coke dry cooler in the form of a shaft comprising a top-receiving chamber containing the charging opening, and therebelow, a cooling chamber of a larger diameter than that of the receiving chamber and having a gas supply and a coke outlet at the bottom end thereof, with the gases which flow upwards countercurrently through the coke charge being withdrawn through a gas outlet disposed in the top part of the cooling-chamber wall, which projects outwardly with respect to the receiving chamber.

It has been found that in a dry cooler of the kind indicated above, difficulties which have arisen in connection with uneven particle distribution can be overcome by providing, in the region of the transition between the receiving chamber and the cooling chamber, a continuous inward projection of wear-resistant material.

According to further aspects of the invention, the projection is preferably stepped in the form of a continuous ring of smaller diameter than that of the receiving chamber. Moreover, it is sufficient if the projection projects inward about 100–300 millimeters, preferably 150 millimeters, with respect to the inside wall of the receiving chamber. In one preferred embodiment of the invention, the continuous projection forms a part of the refractory lining of the shaft.

The continuous projection in the region of the transition between the receiving chamber and the cooling chamber forms a means of inhibiting separation of the mixture of particles of coke processed in the cooler. Here, at the projection, the charge is rearranged. The coarse pieces of coke which moved toward the wall when the coke was charged into the receiving chamber and which moved down the wall experience a change of direction as they pass the projection and are distributed over the middle part of the main cooling chamber. The speed of descent of the outer pieces of coke in the receiving chamber is thus reduced or decelerated, so that the charge falls more rapidly in the middle portion of the receiving chamber than in the edge portion thereof. This results in the formation, in the receiving chamber, of a negative charge cone, so that some of the outer, coarse pieces move inwardly in the region of this cone in the actual receiving chamber, and as a consequence, there is a more favorable distribution of particles in the receiving chamber itself.

In the drawing, the shaft oven illustrated in longitudinal section consists of a receiving chamber 1 having a top charging opening 2 and a cooling chamber 3 adjoining the bottom end of the receiving chamber 1. Like the receiving chamber 1, the cooling chamber 3 is of cylindrical construction, but it has a larger cross section than does the receiving chamber 1. The cooling chamber 3 has therebelow a conical outlet 4 together with a coke outlet 5. Gas outlets 6 are provided at the top end of the cooling chamber 3, which is wider than the receiving chamber 1. The gas outlets 6 are disposed in the top part of the wall of the cooling chamber 3 and are used to discharge the heat cooling gas, which is withdrawn through an annular main 7.

The cooling gas enters the shaft cooler through annular chambers 8 and 9 which surround the conical outlet 4. The cooling gas passes up through the charge from the annular chamber 8 via pipes 10 and a centrally-disposed pipe portion 11, which is open at the bottom, while the gas entering through the annular chamber 9 reaches the charge through apertures 13 at the bottom end of the conical outlet 4.

In the embodiment illustrated, radial walls 14 extend from a central brickwork core 12 which tapers to a point at the top, the said walls 14 dividing the cooling chamber 3 into three sub-shafts. The walls 14 bear on the box-shaped gas-supply pipes 10.

A continuous annular projection 15 is provided in the region of the transition between the receiving chamber 1 and the cooling chamber 3. The projection 15 is of step-shaped construction, and it projects about 150 millimeters with respect to the inside diameter d of the receiving chamber 1. The continuous projection 15 may form a part of the refractory lining 17 of the shaft oven. As shown in the drawing, the stepped-shaped construction of projection 15 is formed by two rings of different diameters, the smaller diameter ring being at the bottom of the chamber and adjoined by a horizontal surface to the upper ring. The projection 15 consists of a wear-resistant material, and it is preferably so constructed and fitted into the brickwork of the receiving chamber 1 as to be replaceable in the event of wear.

The drawing shows how the coarser pieces of coke falling along the wall of the receiving chamber 1 pass over the projection 15 to the central part of the container in the region of the transition between the receiving chamber 1 and the cooling chamber 3, and thus are distributed uniformly over the complete charge, so that the finer materials can move upwards. At the same time, because of the higher speed of descent in the middle zone, a negative charge cone forms in the receiving chamber 1, as shown by line 16, and provides more favorable particle distribution in the receiving chamber 1 itself. The charge surfaces which are formed in the region of the widened portion, i.e., cooling chamber 3, and above which the heated cooling gas is withdrawn, have been shown at 18.

Although the invention has been shown in connection with a certain specific embodiment, it will be readily apparent to those skilled in the art that various changes in form and arrangement of parts may be made to suit requirements without departing from the spirit and scope of the invention.

We claim as our invention:

1. A coke dry cooler in the form of a shaft comprising a top cylindrical receiving chamber of substantially constant diameter throughout its height containing a charging opening, and therebelow, a cylindrical cooling chamber having a diameter larger than that of said receiving chamber and having a gas supply and a coke outlet at its bottom end, gas-outlet means disposed in the top part of the wall of said cooling chamber for withdrawing the gases which flow upwards countercurrently with respect to the coke charge, the top part of said cooling chamber wall projecting outwardly with respect to said receiving chamber, characterized in that in the region of the transition between said cylindrical receiving chamber and said cooling chamber said shaft is provided with a continuous annular projection which is highly resistant to wear and is stepped to project inwardly with respect to the wall of said receiving chamber for forming a negative coke charge cone therein.

2. A cooler as defined in claim 1 wherein said annular projection is in the form of stepped rings having diameters smaller than that of said receiving chamber.

3. A cooler as defined in claim 2 wherein said projection projects inwardly about 100–300 millimeters with respect to the inside diameter of the receiving chamber.

4. A cooler as defined in claim 1 wherein said projection projects inwardly about 100–300 millimeters with respect to the inside diameter of the receiving chamber.

5. A cooler according to claim 1 wherein said projection forms a part of the refractory lining of said shaft.

6. A cooler as defined in claim 5 wherein said projection projects inwardly about 100–300 millimeters with respect to the inside diameter of said receiving chamber.

7. A cooler as defined in claim 6 wherein said projection is in the form of stepped rings having diameters smaller than that of said receiving chamber, said stepped rings including a lower ring adjoined by a horizontal surface to the upper one of said rings.

* * * * *